US006322479B1

(12) United States Patent
Pharaoh

(10) Patent No.: US 6,322,479 B1
(45) Date of Patent: Nov. 27, 2001

(54) CARPAL LIGAMENT STRETCH PAD

(76) Inventor: Raymond G. Pharaoh, 30 Valley Bend Ct., Germantown, MD (US) 20876

( * ) Notice: Subject to any disclaimer, the term of this patent is extended or adjusted under 35 U.S.C. 154(b) by 0 days.

(21) Appl. No.: 09/558,271

(22) Filed: Apr. 25, 2000

(51) Int. Cl.[7] ..... A63B 23/14
(52) U.S. Cl. ..... 482/44; 482/49; 482/21
(58) Field of Search ..... 482/44, 49, 91, 482/121, 122, 47, 21, 128, 907; 601/40; 128/898, 77, 26, 25 R, 878, 879; 446/46; 273/424, 428

(56) References Cited

U.S. PATENT DOCUMENTS

| | | | | |
|---|---|---|---|---|
| 1,958,807 | * | 5/1934 | Thompson | 482/21 |
| 3,265,389 | * | 8/1966 | Carlson . | |
| 4,524,464 | * | 6/1985 | Primiano et al. | 2/161 |
| 4,850,341 | | 7/1989 | Fabry et al. . | |
| 5,366,436 | | 11/1994 | Gibney . | |
| 5,447,490 | | 9/1995 | Fula et al. . | |
| 5,603,679 | * | 2/1997 | Reis | 482/106 |
| 5,672,150 | * | 9/1997 | Cox | 602/21 |
| 5,716,303 | * | 2/1998 | Scatterday | 482/49 |
| 5,766,142 | * | 6/1998 | Hess | 602/22 |
| 5,772,620 | * | 6/1998 | Szlema et al. | 602/21 |
| 6,010,431 | | 1/2000 | Taylor . | |
| 6,042,520 | * | 3/2000 | Cantero | 482/79 |

* cited by examiner

*Primary Examiner*—Jerome W. Donnelly
*Assistant Examiner*—Lori Baker Amerson
(74) *Attorney, Agent, or Firm*—Randal D. Homburg

(57) ABSTRACT

The invention is a therapeutic rehabilitation device for person having carpal tunnel syndrome or recovering from carpal tunnel surgery, the device being made of a formed flexible pad of moldable thermoplast covered in foam padding for post surgical treatment of the flexor retinaculum ligament using palm pressure or by applying pressure between the index finger and thumb.

2 Claims, 2 Drawing Sheets

CARPAL LIGAMENT STRETCH PAD

CROSS REFERENCE TO RELATED APPLICATIONS

None.

BACKGROUND OF INVENTION

1. Field of the Invention

The invention is a therapeutic rehabilitation device for person having carpal tunnel syndrome or recovering from carpal tunnel surgery, the device being made of a formed flexible pad of moldable thermoplast covered in foam padding for post surgical treatment of the flexor retinaculum ligament using palm pressure or by applying pressure between the index finger and thumb.

2. Description of Prior Art

The following United States patents are disclosed herein and incorporated into this application for utility patent. All relate to therapy devices for the hand. In U.S. Pat. No. 6,010,431 to Taylor, a method and polymeric foam apparatus is disclosed which is design to reduce the problems associated with repetitive stress injuries by pushing down on the upper surface of the device, urging the sides of the palm apart, the device having a central cutout portion allowing for the inward penetration of the palm region.

A finger rehabilitation system providing an elastic resistance to the extension of a finger, such device attaching to the wrist and hand is disclosed in U.S. Pat. No. 5,447,490 to Fula. A non-invasive device for treating carpal tunnel syndrome is disclosed in U.S. Pat. No. 5,366,436 to Gibney, comprising an elastic member removably attaching the distal ends of the fingers and thumb of the affected hand, forcing the fingers and thumb away from each other against the elastic force of the device. A glove protecting the median nerve of the hand and providing a foam pad in the glove in the palm region between the ball of the thumb and the palm heel from stress, shock and vibration which can produce carpal tunnel syndrome.

SUMMARY OF THE INVENTION

The primary objective of the invention is to provide an easy to use therapeutic device for use by persons recovering from carpal tunnel surgery to treat the flexor retinaculum ligaments using palm pressure or pressure from the index finger and thumb. A second objective is to provide a therapeutic device to persons having an injury to the carpal tunnel region to recover strength and flexibility.

DESCRIPTION OF THE DRAWINGS

The following drawings are submitted with this utility patent application.

DESCRIPTION OF THE PREFERRED EMBODIMENT

The invention, as shown in FIGS. 1–4 of the drawings, is a device 10 for the post-treatment therapy and rehabilitation of the flexor retinaculum ligament of the human hand, comprising an ovoid-shaped, moldable, resiliently deformable wafer 20 having an upper side 22 and a lower side 30.

Figure 1:
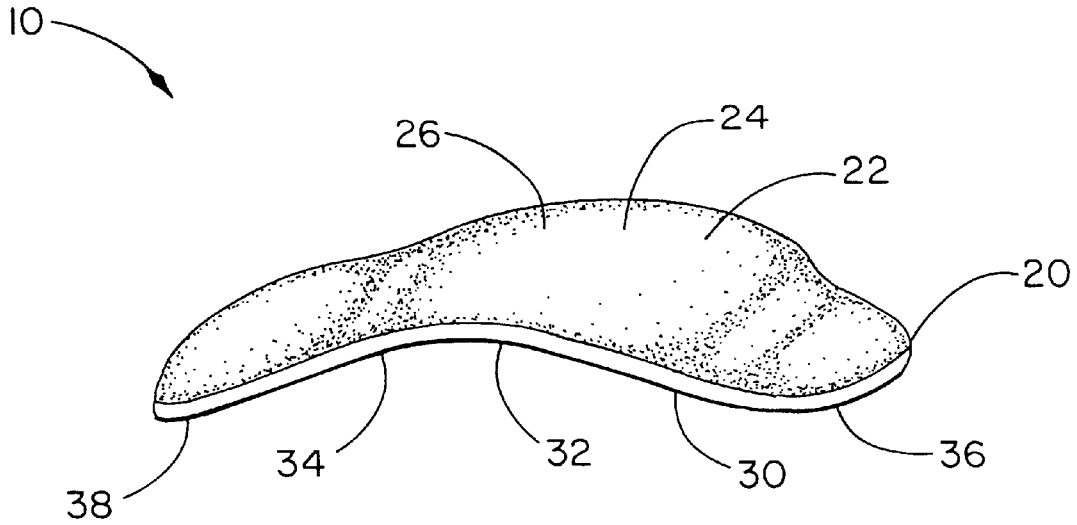
FIG. 1 is a perspective upper view of the invention.
Figure 2:
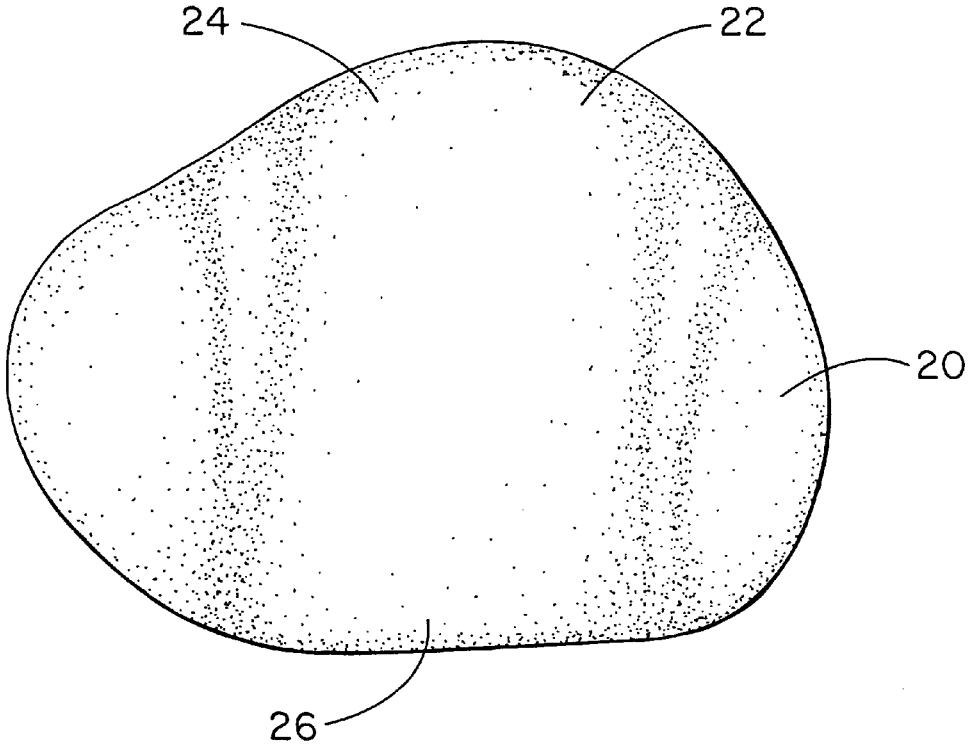
FIG. 2 is a top view of the invention.
Figure 3:
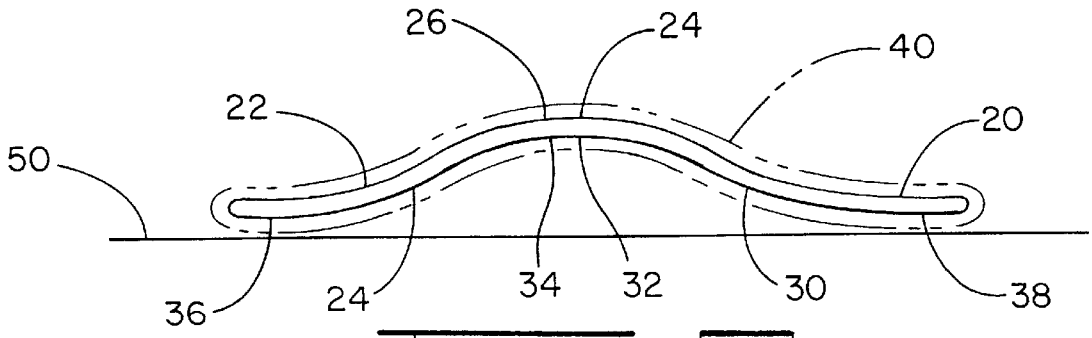
FIG. 3 is a side view of the invention.

The upper side 22, as shown in FIGS. 2 and 3 of the drawings, has a central portion 24 having a curved raised area 26 conforming to the natural curvature of the palm of a human hand. The lower side 30, also shown in FIGS. 2 and 3 of the drawings, is concave, also having a central portion 32, a depressed area 34 and two side 36, 38 which will lie upon a flat firm surface 50 upon which the device 10 would be positioned during use. In one embodiment, the entire wafer 20 may be covered in a foam padding 40 to add cushion to the wafer 20.

In use, the wafer 20 is first molded to the shape of the users hand. In this regard, the wafer 20 is most preferable made of a thermoplast material, which would be deformable when heated, but maintaining a rigid flexible state at room temperature. The device 10 is then place on a flat firm surface 50 with the lower side 30 of the device resting on such hard flat surface 50 with the two sides 36, 38 of such lower side 30 in contact with the flat firm surface 50, while the depressed area 34 of the lower side 30 is elevated above the flat firm surface 50.

Figure 4:
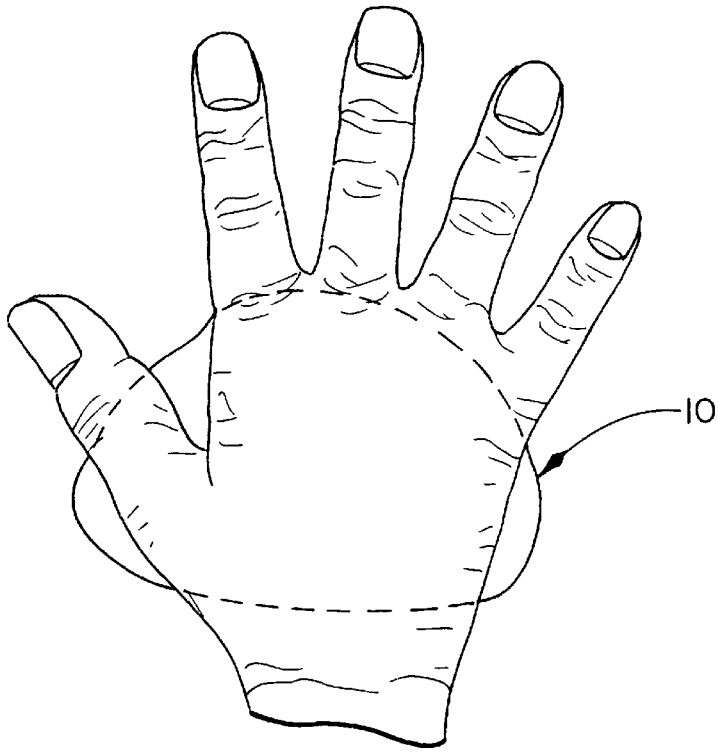
FIG. 4 is a view of the invention in relation to a hand.

As shown in FIG. 4 of the drawings, the user then places the affected hand on the upper side 22 of the device 10 and applies a downward force upon such device 10, bending the wafer 20 in an attempt to urge the depressed area 34 of the lower side 30 towards the flat firm surface 50. The device 10 causes the palm of the hand to be stretched, spreading the thumb and the smallest finger away from each other, which causes a stretching of the flexor retinaculum ligament of the hand. Increased pressure applied to the device 10 will cause an increase in the stretching of the ligament.

A method for utilizing the device 10 includes placing the device 10 with the two sides 36, 38 of the lower side 30 lying on a flat firm surface 50, placing the palm of the hand on the upper surface 22 of the device, applying a downward force against the device 10, urging the central portion 24 of the upper side 22 and the central portion 32 of the lower side 30 towards the flat firm surface 50, stretching the flexor retinaculum ligament of the human hand, releasing the force against the device 10, and repeating the application of downward force until sufficient therapy has been obtained.

While the invention has been particularly shown and described with reference to a preferred embodiment thereof, it will be understood by those skilled in the art that changes in form and detail may be made therein without departing from the spirit and scope of the invention.

What is claimed is:

1. A method for using a device for the post-treatment therapy and rehabilitation of the flexor retinaculum ligament of the human hand, comprising the steps of:

a. providing a device as an ovoid-shaped, moldable, resiliently deformable wafer having an upper side and a lower side, said upper side having a central portion having a curved, raised area and said lower side being concave and also having a central portion having a curved depression and two sides, the wafer made of a thermoplastic material, which would be deformable when heated while maintaining a rigid flexible state at room temperature;

b. placing the device with the two sides of the lower side lying on a flat firm surface;

c. placing a palm of a hand on the upper side of the device;

d. applying a downward force against the device, urging the central portion of the upper side and the central portion of the lower side towards the flat firm surface, stretching the flexor retinaculum ligament of the human hand;

e. releasing the force against the device; and f. repeating the application of downward force until sufficient therapy has been obtained.

2. A device for using the method of post-treatment therapy and rehabilitation of the flexor retinaculum ligament of the human hand of claim 7, comprising:

an ovoid-shaped, moldable, resiliently deformable wafer having an upper side and a lower side, said upper side having a central portion having a curved, raised area and said lower side being concave and also having a central portion having a curved depression and two sides, the wafer made of a thermoplastic material, which would be deformable when heated while maintaining a rigid flexible state at room temperature.

* * * * *